United States Patent [19]

Terai et al.

[11] 3,935,349

[45] Jan. 27, 1976

[54] PROCESS OF COATING AN ALUMINUM ARTICLE

[75] Inventors: Shiro Terai, Nagoya; Akinari Ichiryu, Aichi; Toshio Suzuki, Kasugai; Toshinori Maeda, Nagoya, all of Japan

[73] Assignee: Sumitomo Light Metal Industries, Ltd., Tokyo, Japan

[22] Filed: Oct. 1, 1973

[21] Appl. No.: 402,364

[30] Foreign Application Priority Data

Oct. 6, 1972 Japan ..... 47-101027

[52] U.S. Cl. ..... 427/409; 148/6.27; 204/38 A; 427/327; 427/387; 427/388; 428/450

[51] Int. Cl.[2] ..... B05D 7/14; C23F 7/06

[58] Field of Search ..... 117/75, 135.1, 132 B, 49; 427/409, 327, 387, 388; 148/6.27

[56] References Cited

UNITED STATES PATENTS

| | | | |
|---|---|---|---|
| 2,902,389 | 9/1959 | Keil | 117/75 X |
| 3,175,921 | 3/1965 | Hedlund | 117/75 |
| 3,664,888 | 5/1972 | Oga et al. | 117/49 X |
| 3,706,592 | 12/1972 | Thomson | 117/135.1 |
| 3,711,313 | 1/1973 | Nagano et al. | 117/75 X |
| 3,734,784 | 5/1973 | Bereday et al. | 117/75 X |

*Primary Examiner*—Ralph Husack
*Attorney, Agent, or Firm*—Larson, Taylor and Hinds

[57] ABSTRACT

A paint film based on a thermo-setting resin which is applied on an aluminum article may be improved in its adhesion properties and resistance to chemical and mechanical attacks as well as in its resistance to weathering, if the surface of the aluminum article is previously anodized to form the oxide surface layer or is treated in boiling water to form the boehmite surface layer and if the oxide surface layer, including the boehmite layer, is pre-treated with a silane compound prior to the application of the coating composition. The application of the paint composition is conducted in this invention by means of a known coating technique such as dipping, spraying, showering, brushing or roller-coating, other than the electro-deposition technique.

4 Claims, No Drawings

PROCESS OF COATING AN ALUMINUM ARTICLE

This invention relates to a process for coating an article of aluminum or an aluminum base alloy.

It is known that a surface of metallic aluminum can be made resistant to corrosion by applying an aqueous solution of a water-soluble mono-organosilane immediately on said surface and then heat-curing the applied mono-organosilane coating at a temperature of at least 100°C (see U.S. Pat. No. 3,061,467). In this prior art, the coating film of the cured mono-organosilane formed on the aluminum surface merely provides a barrier by which the aluminum surface can be prevented from contacting with an agent such as acids, bases, salts, oxygen and the like, which otherwise would result in the corrosion of the metallic aluminum surface. On the other hand, it is well known that the aluminum metal surface can be treated by anodizing (namely, anodically oxidizing) the aluminum surface in an electrolyte containing sulfuric acid, chromic acid or oxalic acid etc., with a direct or alternating electric current, so that the aluminum surface is provided with a micro-porous oxide layer essentially consisting of gamma-alumina. It is also known that the aluminum metal surface can be provided with a micro-porous oxide layer consisting of alumina mono-hydrate (boehmite) by treating the aluminum metal surface in boiling water which may optionally contain a quantity of ammonia or an amine such as triethanolamine. In previous research, we found that when an anodized aluminum article provided with the oxide (gamma-alumina) surface layer formed through the anodizing treatment is pre-treated with an organo-silicone compound and then coated with a paint film of a thermo-setting resin by electrodeposition, the properties of the resin coating as well as the thickness (film build) of the resin coating are improved as compared to when the resin coating is applied to the surface of the anodized aluminum article without pretreating with the organo-silicon compound. As a result of our further research, we have now found that also when the anodized aluminum article is pre-treated with the organo-silicon compound and the subsequent application of the thermo-setting resin coating is conducted by such techniques as dipping, spraying, showering, brushing, bar-coating, roll-coating and doctor-knife-coating etc., other than the aforesaid electrodeposition technique, the properties of the resin coating applied are improved similarly to the case when the electrodeposition technique is employed to apply the resin coating. We have further found that this favorable result is obtained with success also when the aluminum metal surface to be pre-treated with the organo-silicon compound has been provided with the boehmite layer by treating the said aluminum surface in boiling water.

Heretofore, aluminum metal has been used as a substrate material for the manufacture of a container for foodstuffs. When a container or foodstuffs is manufactured from aluminum metal, a strip of aluminum metal is anodized to form a very thin oxide layer at the surface thereof. The anodized aluminum strip is then cut into sheets of appropriate size which are then moulded into a container of desired shape. The container so shaped is then after-processed by washing with water, drying and other procedures, immediately followed by coating with a sanitary lacquer. However, such an anodized aluminum strip provided with the thin oxide layer which has been formed by subjecting the aluminum strip to the anodizing process as the priming treatment has substantially not been employed as a substrate material for the manufacture of other articles than the food container. Besides, the kinds of the food containers which may be manufactured from the anodized aluminum strip are restricted. A first reason for this is that the kinds of the coating compositions of thermo-setting resin which can exhibit a good adhesion to the anodized aluminum surface are few and such paint compositions based on a thermo-setting acrylic or organo-silicone resin which are commonly used for coating the building or constructing materials do not always shows a good adhesion to the anodized aluminum surface. The second reason is that the sanitary lacquer-coated container for foods which is made of the anodized aluminum strip still has a risk that it can be corroded due to the acidity of acidic foods. Furthermore, pasteurization of the containers for foods which has usually been conducted by steaming or boiling in water is likely to involve a stripping or blistering of the resin coating which has been applied on the substrate material of the container, as long as the paint film is not well adhering to the substrate material.

An object of this invention is to eliminate the above-mentioned difficulties and to provide an improved process for coating an anodized aluminum article by which the adhesion of the resin coating applied to the surface of the article is very much enhanced and by which there is produced such a resin-coated aluminum article which has a resin coating highly resistant to mechanical and chemical attacks and hence is suitable as a material for manufacturing various kinds of containers and constructive materials.

With respect to the alumina layer which is formed at the aluminum metal surface by anodizing this surface, as well as to the boehmite layer which is formed at the aluminum surface by treating this surface with boiling water possibly containing ammonia or an amine, we have found that the alumina layer and the boehmite layer are rich in aluminol of the formula AlOH and are of hydrophilic nature. We have also found that when the hydrophilic surfaces of the above-mentioned microporous alumina layer or boehmite layer are treated with an organo-silicon compound containing such reactive functions as hydroxyl group, methoxy group, ethoxy group and the like, the organo-silicon compound penetrates into the micro-porous structure of the oxide surface layer and the reactive function of the organosilicon compound are condensed with the aluminol to give an organic compound of aluminum silicate which gives a film extending substantially to cover the oxide surface layer of the aluminum substrate material. The film of the organic compound of aluminum silicate so formed is able to function as an effective primer for various kinds of the known coating compositions of thermo-setting resin which are subsequently applied thereon. The mechanism for this is as follows: When the oxide surface layer, including the boehmite surface layer, is treated with an organo-silicon compound containing reactive functions such as amino group, hydroxyl group, methoxy group and/or ethoxy group and the like and then coated with a known coating composition of a thermo-setting resin, followed by heat-curing the resin coating on said oxide or boehmite surface layer, some hydroxyl groups or methoxy groups etc., of the organo-silicon compound react with the aluminol present in the oxide surface layer, while the amino groups aand the remaining hydroxyl groups or methoxy groups etc., as well as the other reactive groups of the organic silicon compound also react with the organic reactive groups such as carboxyl, hydroxyl, methylol, alkoxymethylol and epoxy groups of the thermo-setting resin present in the coating composition used, so that the organo-silicon compound acts as a coupling or cross-linking agent to make the oxide layer and the resin coating integrated with each other.

We have devised the process of this invention on the basis of the above-mentioned findings. According to this invention, therefore, there is provided a process for coating an aluminum article, which comprises treating with an organo-silicon compound such an aluminum article which has been anodically oxidized to form the anodized oxide layer at the surface thereof or which has been treated in boiling water to form the boehmite layer at the surface thereof, and then coating the aluminum article so treated with a known coating composition of a thermo-setting resin by a known coating technique other than the electrodeposition technique, and finally heat-curing the resin coating on the aluminum article.

According to an embodiment of this invention, there is provided a process for coating an aluminum article, which comprises treating an aluminum article having the anodized oxide surface layer or the boehmite surface layer with a silane compound of the formula:

$$[R(CH_2)_n]_m-Si-X_{4-m}$$

wherein $m$ is an integer of 1, 2 or 3; $n$ is zero or an integer of 1, 2 or 3; R is an alkenyl group of 1–4 carbon atoms such as vinyl and allyl when $n$ is zero; but R is amino group, an alkylenediamino group of 1–4 carbon atoms such as ethylenediamino, propylenediamino, tetramethylenediamino and hexamethylenediamino, an alkanolamino group of 1–4 carbon atoms such as diethanolamino, or mono- or di-propanolamino; an $\alpha,\beta$-unsaturated lower aliphatic carboxylic acid residue (more exactly speaking, $\alpha,\beta$-unsaturated alkyl-carbonyloxy group of 3–7 carbon atoms) such as acrylic acid residue, methacrylic acid residue and crotonic acid residue, an alkoxyl group having an epoxy group and containing 1–4 carbon atoms, such as glycidoxy or an cycloalkyl group having an epoxy group and containing 3–6 carbon atoms such as epoxy-cyclohexyl when $n$ is 1, 2 or 3; X is at least one group which is reactive with the aluminol and is selected from the group consisting of hydroxyl group, an alkoxy group of 1–4 carbon atoms such as methoxy, ethoxy, propoxy and butoxy; a lower alkoxy-alkoxy group of 2–8 carbon atoms such as methoxyethoxy, methoxypropoxy and methoxybutoxy; a saturated lower aliphatic carboxylic acid residue of 2–5 carbon atoms such as acetic, propionic and butyric acid residue; an alkyl group of 1–4 carbon atoms such as methyl, ethyl propyl and butyl; and an alkoxy-peroxy group of 1–4 carbon atoms, excepting that all the groups represented by X are alkyl at the same time; then coating the so treated aluminum article with a known coating composition containing a thermo-setting resin as the film-forming material by applying said coating composition onto the oxide layer surface of the aluminum article by means of a known dipping, spraying, showering, brushing, bar-coating or roller-coating or doctor-knife-coating or other application technique than the electrodeposition technique, and finally heat-curing the resin coating on the aluminum article.

With respect to the silane compound of the formula:

$$[R(CH_2)_n]_m-Si-X_{4-m}$$

the terminal groups —X are reactive groups which will react with the aluminol to form a strong bond with the aluminol, so that the organo-silicon compound is strongly anchored to the oxide surface layer of the aluminum substrate, whereas the groups $[R(CH_2)_n]_m$— are reactive groups which will react with the reactive groups of the film-forming resin material of the coating composition used. When $n$ is an integer of 1—3, the group —$(CH)_n$— may be methylene, ethylene or trimethylene group. When $m$ is an integer of 2 or 3, the groups $[R(CH_2)_n]_m$— may the same or different from each other. When $m$ is an integer of 1 or 2, the groups —X may be the same or different from each other. However, such a silane compound of the above formula wherein all the groups —$X_{4-m}$ represent the same or different alkyl groups(s), including the case where $m$ is 3 and the single remaining group —X then stands for an alkyl group, is not suitable for use in the present process because of its poor reactivity to the film-forming resin material of the coating composition. The term "aliphatic carboxylic acid residue" referred to in the above formula and hereinafter means such a radical which is derived by eliminating the hydrogen atom from the carboxyl group of the carboxylic acid. Accordingly, the term "$\alpha,\beta$-unsaturated lower aliphatic carboxylic acid residue" described in this specification and the claims may also be defined as an $\alpha,\beta$-unsaturated alkyl-carbonyloxy group containing 3–7 carbon atoms. Examples thereof may be acryloyloxy group $CH_2{=}CH{-}CO{-}O{-}$, methacryloyloxy group $CH_2{=}C(CH_3){-}CO{-}O{-}$ and crotonoyloxy group $CH_3CH{=}CH{-}CO{-}O{-}$ and the like. Similarly, the term "an saturated lower aliphatic carboxylic acid residue" described herein may also be defined as an alkanoyloxy group of 2–6 carbon atoms, and examples thereofare acetoxyl, propionyloxy, butyryloxy and the like.

Suitable examples of the organo-silicon compound of the above mentioned general formula are shown below.

---

(1) Vinyl tri-ethoxysilane
$CH_2{=}CHSi(OCH_2CH_3)_3$ (2) Vinyl tris-tertiary-butylperoxysilane $$CH_2{=}CHSi(OO\overset{\overset{CH_3}{|}}{\underset{\underset{CH_3}{|}}{C}}{-}CH_3)_3$$

(3) Vinyl tris-($\beta$-methoxyethoxy)silane
$CH_2{=}CHSi(OCH_2CH_2OCH_3)_3$ (4) Vinyl tri-acetoxysilane $$CH_2{=}CHSi(O\overset{\overset{O}{|}}{C}CH_3)_3$$

(5) Y-Aminopropyl tri-ethoxysilane
$H_2N(CH_2)_3Si(OCH_2CH_3)_3$ (6) $\beta$-Aminoethyl tri-ethoxysilane
$H_2N(CH_2)_2Si(OCH_2CH_3)_3$ (7) Aminomethyl tri-ethoxysilane
$H_2NCH_2Si(OCH_2CH_3)_3$ (8) Y-Aminopropyl tri-methoxysilane
$H_2N(CH_2)_3Si(OCH_3)_3$ (9) N-($\beta$-aminoethyl)-Y-aminopropyl tri-methoxysilane
$H_2N(CH_2)_2NH(CH_2)_3Si(OCH_3)_3$

(10) N-($\beta$-aminoethyl)-Y-aminopropyl methyldimethoxysilane
$H_2N(CH_2)_2NH(CH_2)_3Si(CH_3)(OCH_3)_2$

(11) Y-Methacryloyloxypropyl tri-methoxysilane

-continued $CH_2{=}C(CH_3)\overset{O}{\overset{\|}{C}}O(CH_2)_3Si(OCH_3)_3$

(12) Y-N,N-di-ethanolaminopropyl tri-ethoxysilane
$(HOCH_2CH_2)_2N(CH_2)_3Si(OCH_2CH_3)_3$

(13) Y-Glycidoxypropyl tri-methoxysilane
$CH_2{-}CHCH_2O(CH_2)_3Si(OCH_3)_3$

(14) β-(3,4-Epoxy-cyclohexyl)ethyl tri-methoxy-silane

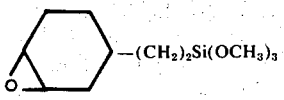

The silanols which are corresponding to the above-mentioned silane compounds, for example, the corresponding aminoalkylsilanols may also be suitable examples of the organo-silicon compound available according to this invention.

When the organo-silicon compound as mentioned above is applied to the oxide surface layer of the aluminum article to treat said oxide surface layer, there is formed a primer layer essentially consisting of an organic compound of aluminum silicate which is produced by the reaction of the organo-silicon compound with the aluminol present in the oxide surface layer. The primer layer so formed exhibits the coupling or cross-linking action on both the underlying oxide layer and the top-coat layer (the paint film) composed of the coating resinous composition subsequently applied, as stated hereinbefore. Therefore, the final resin coating of the coated aluminum article which is produced by the process of this invention is strongly bonded by the chemical linkage to the aluminum substrate and is very much excellent in its adhesive properties and resistance to chemicals and weathering properties.

The process of this invention is now described in more details with respect to its respective stages.

The substrate material for the aluminum article which is used in the present process may be either any grade of pure aluminum or an aluminum base alloy. The aluminum article made of aluminum metal or aluminum alloy which is used in the present process may be of any desired shape such as strip, sheet, panel, tube, bar, rod, cast product or forged product.

The aluminum article which is to be pre-treated with the organo-silicon compound according to this invention should be provided either with the oxide surface layer which has been produced by anodizing the surface of the aluminum article, or the boehmite surface layer which has been produced by treating the aluminum surface in boiling water. To produce the oxide surface layer of the aluminum article, the anodizing treatment (namely, the anodically oxidizing treatment) may be carried out in a known manner in the art. As it is necessary to produce the oxide surface layer of a highly hydrophilic nature for the purpose of this invention, however, it is effective to carry out the anodizing treatment under the following electrolysing conditions. Thus, the anodizing treatment may preferably be carried out at a current density of 0.3 – 120 A/dm², at an electrolyte bath temperature of 10°–90°C using as the electrolyte an aqueous solution of 10–30% by weight of sulfuric acid. The anodizing treatment may continue for such a period of time as to give a desired thickness of the oxide layer at the surface of the aluminum article which is being anodized. The necessary duration of the anodizing treatment naturally varies depending on the desired thickness of the oxide layer to be formed, but in general, a longer duration of the anodizing treatment is needed at a lower current density and a necessary duration of the anodizing treatment is shorter at a higher current density. When 20% aqueous sulfuric acid is employed as the electrolyte bath, it is preferred to conduct the anodizing treatment for a few seconds at an electrolyte bath temperature of 50°–70°C and at a high current density of 20–55 A/dm², because these anodizing conditions are suitable to give a highly hydrophilic oxide layer at the surface of the aluminum article. Although the thickness of the oxide surface layer so formed is not critical, it is preferable that the thickness of the oxide surface layer is smaller, in order that the subsequent operations are facilitated. For instance, even a thickness of 0.05 – 0.8 micron or of 0.5–30 mg/dm² for the oxide surface layer is sufficient to achieve the purpose of this invention. The highly hydrophilic oxide surface layer may also be obtained when at least one of magnesium chloride, citric acid, oxalic acid, tri-ethanol amine and sodium sulfate is added at a concentration of 0.1–5% by weight to an aqueous solution of sulfuric acid which is used as the electrolyte in the anodizing treatment. In addition to the electrolyte mainly comprising surfuric acid, an electrolyte mainly comprising oxalic acid, chromic acid or organic sulfonic acid of various kinds may be employed in the anodizing treatment to give the hydrophilic oxide surface layer which is available in the process of this invention. The electric current employed in the anodizing treatment may be a direct current or an alternating current or even a combination of a direct current and an alternating current. Any anodizing conditions and procedures which are known and commonly employed in the prior art of the anodizing treatment of an aluminum article may be utilized to produce the hydrophilic oxide surface layer which is available in the process of this invention.

To produce the boehmite surface layer at the surface of the aluminum article, the aluminum surface may be treated with boiling water. When the aluminum surface is boiled in de-ionized water, a hydrophilic surface layer essentially consisting of the boehmite and rich in the aluminol is formed. The formation of the hydrophilic boehmite surface layer is promoted when the de-ionized water bath employed has been adjusted to a pH of 9–11 by addition of aqueous ammonia thereto. Similar results may be obtained also when the de-ionized water bath has been made alkaline by adding an amine such as tri-ethanol amine thereto. Because the boehmite surface layer so formed is able to act as the equivalent to the oxide surface layer which is formed by the anodizing treatment, the boiling-water treatment for the boehmite formation may continue for a period of time sufficient to give a thickness of 0.05–0.8 micron for the boehmite surface layer similarly to the anodized surface layer of the aluminum article.

In the process of this invention, the aluminum article having the so formed oxide surface layer, including the boehmite surface layer, is treated with the organo-silicon compound in such a manner that a solution or dispersion of the organo-silicon compound in water or in aqueous organic solvent such as aqueous alcohols, ketones and amines is applied to the outer face of the oxide surface layer of the aluminum article. When an aqueous solution or an aqueous dispersion of the organo-silicon compound is to be used in this treatment, the aluminum article having the oxide surface layer is well washed with water to remove the electrolyte material or ammonia which is still adhering to and adsorbed by the surfaces of the aluminum article, and subsequently the aluminum article so rinsed is applied on the outer surface with an aqueous solution or dispersion of the organo-silicon compound by dipping the article in the aqueous solution or dispersion, or by showering or spraying or brushing or roll-coating the aqueous solution or dispersion onto the surfaces of the article. It is desirable that the aluminum article so treated is then drained to remove the extra liquid and is further dried. The drying may be done by means of clean air at ambient temperature or at an elevated temperature. When a solution of the organo-silicon compound in an organic solvent such as alcohols, esters, ketones and aliphatic hydrocarbons is to be used for the treatment, the aluminum article with the formed oxide surface layer is at first dried prior to the application of the solution of the organic silicon compound. In this case, the drying may be done by means of clean air at ambient temperature or at an elevated temperature. After the drying, the solution of the organo-silicon compound in an organic solvent is applied to the surface of the aluminum article by dipping the article in said solution or by showering or spraying or brushing said solution onto the surface of the article.

The aluminum article to which the solution of the organo-silicon compound has been applied may then be freed from the solvent of said solution which is carried by and adhering to the surface of the aluminum article, to avoid a risk that any remaining quantity of the solvent would bring about any formation of unwanted defects during the subsequent stage of coating the aluminum article with the resin film. In order to remove the extra solvent for this purpose, a clean air at ambient or elevated temperature is blown onto the surface of the aluminum article to evaporate off the solvent from the surface. Depending on the nature of the coating composition which is to used in the subsequent resin-coating stage, however, it is possible to omit the above-mentioned removal of the solvent and hence to apply the coating composition immediately onto the surface of the alauminum article which is still carrying the solvent of the organo-silicon compound solution.

The solution of the organo-silicon compound in water or an aqueous organic solvent or an organic solvent which is used in the present process may suitably contain the organo-silicon compound at a concentration of 0.05 – 5.0% by weight of the solution. If the concentration of the organo-silicon compound in the solution is less than 0.05% by weight, the required duration of the treatment is uselessly longer and it is more difficult to control the concentration of the organo-silicon compound in the treating solution used. On the other hand, if this concentration is in excess of 5%, the gloss of the subsequently applied resin coating is likely to increase undesirably over a pre-determined value owing to the presence of the excessive amount of the organo-silicon compound at the surface of the aluminum article. Besides, the loss of the organo-silicon compound which would occur in spraying the solution can be increased unfavorably.

The organo-silicon compound which has been applied onto the outer face of the oxide surface layer of the aluminum article in the above-mentioned way forms the primer layer made of the organic compound of aluminum silicate which is produced by the interaction between the reactive groups —X of the organo-silicon compound and the aluminol present in the oxide surface layer. During this interaction, the reactive functions —X which are hydroxyl group will immediately react with the aluminol. If the reactive functions —X are an alkoxy group such as methoxy or ethoxy, the alkoxy group is converted by hydrolysis into hydroxyl group which is, in turn, reacted with the aluminol. Although the mechanism of the above interaction is not yet fully elucidated, it is presumed that several reactions take place in the overall interaction of the organo-silicon compound with the oxide surface layer of the aluminum article, for example, according to the following reaction equations:

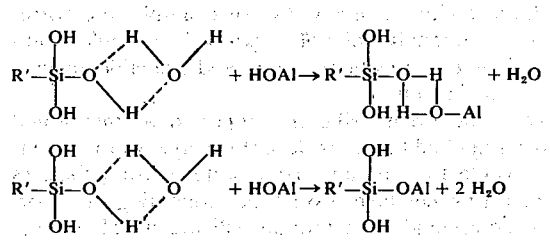

wherein R′ represents the group $[R(CH_2)_n]$— as desribed hereinbefore.

In the process of this invention, the outer surface of the primer layer which has been formed on the oxide surface layer of the aluminum article by treating the oxide surface layer with the organo-silicon compound in the previous stage of the process is then coated with a known coating composition which contains a thermo-setting resin as the film-forming material. The paint composition should be applied to said outer surface of the primer layer in the present process by utilizing a known application techniques such as dipping, spraying, showering, brushing or roll-coating method, other than the electrodeposition technique. The coating composition which is available in the process of this invention includes any known paint composition containing as the film-forming material a thermo-setting resin such as known types of acrylic resins, alkyd resins, epoxy resins, ABS resins, melamine resins, phenol resin or mixtures thereof, that is, melamine-acrylic resins, melamine-alkyd resins, acrylic-epoxy resins, phenol-alkyd resins, phenol-epoxy resins and the like; silicone resins, silicone-polyester resins, fluorine resins and particularrly vinylidene di-fluoride resins.

After the coating composition is applied onto the outer surface of the primer layer formed in the previous step of the present process, the film of the coating composition so applied is then heat-cured in a known manner to give the cured resin coating which covers the outer face of the aforesaid primer layer. In this heat-curing step, the reactive groups of the film-forming resinous material in the coating composition are chemically reacted with the reactive functions such as alkenyl groups, epoxy groups or amino groups etc., which are the group —R present at the terminal of the molecule of the organo-silicon compound which has been bonded to the oxide surface layer of the aluminum article through the reaction of the aluminol with the reactive functions —X present at the opposite terminal of said organo-silicon compound molecule. Occasionally, the reactive groups of the film-forming resinous material are chemically reacted also with the reactive functions —X of the organo-silicon compound which remain unreacted with the aluminol and which possibly have been hydrolyzed into hydroxyl groups. In consequence, cross-linkages are formed between the aluminol of the oxide surface layer of the aluminum article, the organo-silicon compound of the intermediate primer layer and the film-forming resinous material of the coating composition which is most externally applied, with the result that the paint film is strongly bonded to the aluminum substrate of the coated aluminum article.

The following are some examples of the reactions by which the organo-silicon compound is able to be coupled with the film-forming resinous component of the coating composition.

A. In the case where the organo-silicon compound is an epoxysilane:

1. An epoxysilane reacts with an epoxy resin according to the following equation:

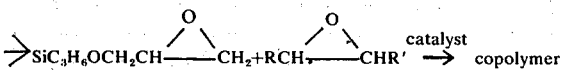

wherein R and R′ represent the residue groups of the epoxy resin used.

2. An epoxysilane reacts with a urea or melamine resin containing amino group, according to the following equation:

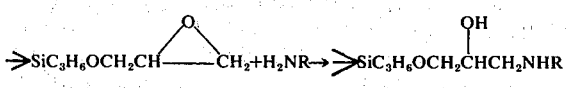

wherein R represents the residue groups of the urea or melamine resin used.

3. An epoxysilane reacts with a resin containing an alcoholic hydroxyl group, such as phenol resin, phenol-formaldehyde resin, melamine-formaldehyde resin and epoxy resin, according to the following equation:

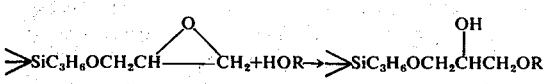

wherein R represents the residue of the phenol or epoxy resin.

4. An epoxysilane reacts with an acid group according to the following equation:

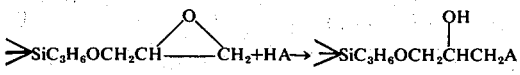

wherein A stands for the residue of the acid HA.

B. In the case where the organo-silicon compound is a vinylsilane or methacryloyloxysilane:

1. Vinylsilane or methacryloyloxysilane is copolymerised with a resin containing aliphatic unsaturated linkages in the presence of free-radical catalyst such as a peroxide.

C. In the case where the organo-silicon compound is an aminosilane:

1. An aminosilane reacts with an epoxy resin according to the following equation:

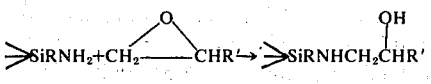

wherein R represents the residue of the aminosilane and R′ represents the residue of the epoxy resin.

2. An aaminosilane reacts with a phenol-formaldehyde resin according to the following equation:

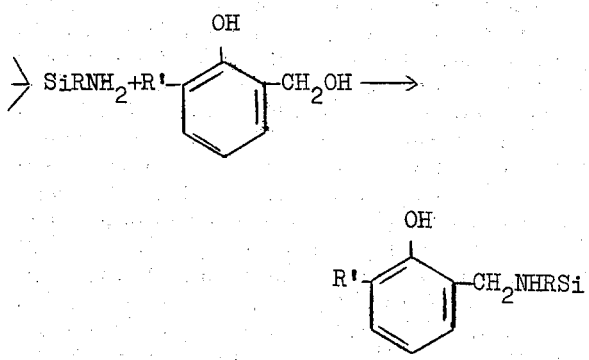

wherein R represents the residue of the aminosilane and R′ represents the residue of the phenol-formaldehyde resin.

3. An aminosilane reacts with a urea or melamine-formaldehyde resin according to the following equation:

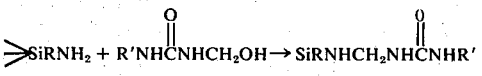

wherein R represents the residue of the aminosilane and R represents the residue of the urea or melamine-formaldehyde resin.

As will be clear from the foregoing description, it is necessary that the organo-silicon compound should be selected depending on the nature of the film-forming resinous component of the coating composition employed, in order to ensure that the organo-silicon compound used can exhibit a most effective coupling or cross-linking reactions with the film-forming resinous components of the coating composition as well as with the aluminol of the oxide surface layer of the aluminum substrate.

In order to prove that the organo-silicon compound reacts with the aluminol of the oxide surface layer on the aluminum substrate to form the new multi-covering layers on the aluminum substrate, the following test was conducted. Thus, a plate of aluminum of a high purity (99.99%) was moderately etched by dipping in an etching bath of an aqueous solution of 10% sodium hydroxide at 60°C for 2 minutes. The etched aluminum plate was then washed with water and neutralized by immersing the plate in a bath of 15% nitric acid at ambient temperature for 30 seconds, and the plate was again rinsed with water. This aluminum plate was then anodized in an anodizing bath of 15% sulfuric acid at 20°C by passing an electric current at a current density of 1 A/dm$^2$ for 30 minutes, so that the oxide layer of 8.5 microns thick was formed at the surface of the aluminum plate. The anodized aluminum plate was washed with water, immediately immersed in an aqueous solution of 3% of N-$\beta$ -(aminoethyl)-$\gamma$-aminopropyl tri-methoxy-silane for 2 minutes at ambient temperature and again rinsed with water. The aluminum plate so treated was then dried by placing in an oven at 135°C. A commercially available coating composition (clear lacquer) based on a thermo-setting acrylic resin was applied by spraying to the dried aluminum plate, and the coated aluminum plate was stoved at 260°C for 60 seconds to cure the acrylic resin of the coating film on the aluminum plate. The resin-coated aluminum plate so obtained was cut to make a test panel of 10 mm × 20 mm in size. This test panel was placed in a mass of a pre-condensate of an epoxy resin which was curable at ambient temperature, and the whole mass was then cured to produce a block of the epoxy resin in which the test panel was embedded. The block was cross-sectioned to cut down the test panel. The cross-section of the cut test panel was carefully polished. This cross-section of the test panel was examined by means of an X-ray micro-analyzer to determine the distribution of the silicon atoms in the cross-section of the oxide surface layer which was on the aluminum substrate. It was detected that the silicon atoms were present substantially throughout the whole cross-section area of the oxide surface layer, and that the aluminum silicate was formed even at the walls of the micro-pores in the oxide surface layer.

The invention is now illustrated with reference to the following Examples to which the invention is not limited.

EXAMPLE 1

A strip of a commercially available pure aluminum (of a grade "JIS H4000, 1200") was anodized in an electrolyte bath of 20% aqueous sulfuric acid at the bath temperature of 70°C by passing an alternating electric current at a current density of 8.0 A/dm$^2$ for 5 seconds through the electrolyte bath. By this anodizing treatment, there was formed the oxide layer of a density 4.0 mg/dm$^2$ on the surface of the aluminum strip. This anodized aluminum strip was well washed with water and cut down to make test panels of 100 mm × 200 mm in size, from which the under-mentioned specimens No. 1 and No. 2 were prepared as described below.

Specimen No. 1

The test panel was dried as such and then coated with a commercially available paint based on a thermosetting acrylic resin which had commonly been applied as a pre-coat for the aluminum article. The coating was made by a usual bar-coating method. The resin coating was stoved at 260°C for 60 seconds. The thickness of the stoved paint film was 22.0 microns.

Specimen No. 2

The test panel was sprayed on its one surface with an aqueous solution of 1 % of N-$\beta$-(aminoethyl)-$\gamma$-aminopropyl trimethoxysilane. The panel so treated was then air-dried by a clean air and subsequently heated for 20 seconds at 150°C to complete the drying. This panel treated with the silane compound was then coated with the same paint based on the thermo-setting resin as that used in the preparation of the above specimen No. 1. The coating was carried out similarly by using the bar-coating method. The resin coating applied was then stoved at 260°C for 60 seconds. The thickness of the stoved paint film was 21.0 microns.

Specimen No. 3

A panel of the same pure aluminum material as that used in the preparation of the specimen Nos. 1 and 2 was de-greased by immersing in an aqueous solution of 15% of $H_2SO_4$ additionally containing 0.5% of a non-ionic surface-active agent (essentially consisting of a polyethylene nonylphenol ether commercially available) at 70°C for 15 minutes. The de-greased panel was then treated with the same silane compound and in the same way as those used in the preparation of the specimen No. 2. The panel so treated was coated with same paint and by the same coating method as those used in the preparation of the specimen No. 1. The stoving of the resin coating was effected in the same manner, too. The thickness of the stoved paint film was 22.5 microns.

The above-mentioned three specimens were tested to estimate the performance of the final paint film. The tests were conducted as follows:

i. Resistance of the coating to impact was tested according to the Du pont procedure wherein a weight of 500 g was dropped from a height onto a short steel cylinder of ½ inch in diameter placed on the coating film. The weight was dropped down from a height onto the steel cylinder to give an impact force to the coating, to which was then adhered adhesive Scotch tape No. 610. An end of the adhesive tape adhering to the coating was pulled away in an attempt to strip off the coating film from the substrate along with the adhesive tape pulled away. The impact resistance of the coating was the maximum height below which the dropping weight did not enable to coating to be stripped by pulling away the adhering tape.

ii. Resistance of the coating to organic solvent was tested by rubbing the surface of the coating with a cotton gauge impregnated with methyl ethyl ketone, until the face of the aluminum substrate was exposed. The solvent resistance of the coating was the maximum number of the cycles of the rubbing strokes.

iii. Resistance of the coating to bending was tested by over-lapping the specimen panel on increasing numbers of additional aluminum panels each of the same thickness as that of the specimen panel, clamping the panel assembly between the jaws of a hand-operated vice and bending the panel assembly by 180°. The bending resistance of the coating was the number of the additional aluminum panels when the coating of the specimen panel could at least partially be stripped off from the aluminum substrate.

iv. Resistance of the coating to boiling water was tested by immersing the panel in boiling water for 5 hours. Visual observation was made to estimate whether the coating was blistered.

v. Secondary properties of the coating were determined in the under-mentioned ways after the coated panel was immersed in boiling water for 2 hours.

vi. After the coated panel was immersed in boiling water for 2 hours, the resistance of the coating (paint film) to impact was tested by the Du pont procedure using a dropping weight of 500 g impinging onto a steel cylinder of ½ inch in diameter placed on the coating film, as well as adhesive Scotch tape No. 610 for stripping off the coating.

The impact resistance of the coating was the maximum height at which the dropping weight positioned initially and below which the dropping weight did not enable the coating to be stripped off by pulling away the adhesive tape adhering thereonto. vii. Scribelines were made through the paint film to the facce of the aluminum substrate. These scribelines were drawn in parallel to each other at intervals of 1mm and the additional scribelines perpendicularly crossing the first scribelines were also drawn at intervals of 1mm, so that 10 × 10 paint film squares of 1mm long in its one side were formed by these scribelines intersecting at sight angles. The panel with the intersecting scribelines was then tested by a standard Erichsen film tester. Adhesive Scotch tape No. 610 was then adhered onto the surface of the scribed paint film of the panel which had been subjected to the action of the Erichsen film tester, and the adhering adhesive tape was pulled away from the paint film, causing the paint film squares to be stripped off from the aluminum substrate. The number of the paint film squares which would not be stripped by the adhesive tape was counted per 100 squares.

viii. Resistance of the coating to mortar cement was tested after the coated panel was immersed in boiling water for 2 hours. The coated panel was allowed to stand for 24 hours after the boiling water treatment and then immersed in a mixture of sand-portland cement-water (2:1:1) for one week, after which visual observation was made to estimate whether the coating was blistered.

The results of the tests obtained are shown in Table 1 below.

TABLE 1

| Specimen | No. 1 (comparative) | No. 2 (this invention) | No. 3 (comparative) |
|---|---|---|---|
| Density(mg/dm²) of the anodized oxide surface layer | 4.0 | 4.0 | 0 |
| The treatment with the silane compound | Not made | Made | Made |
| Thickness of paint film (micron) | 22.0 | 21.0 | 22.5 |
| Impact resistance (test (i)) | 30cm | 30cm | 30cm |
| Solvent resistance (test (ii)) | 28 | More than 100 | 22 |
| Bending resistance (test (iii)) | 3 | 3 | 3 |
| Boiling water resistance (test (iv)) | Paint film blistered | Paint film unchanged | Paint film blistered |
| Secondary properties (test (v)) | | | |
| Impact resistance (test (vi)) | Less than 10cm | 80cm | Less than 10cm |
| Erichsen film test of scribed paint film, followed by stripping (test (vii)) | 0/100 (Whole area of paint film was stripped) | 100/100 (Paint film was not stripped at all) | 20/100 (Substantially whole area of paint film was stripped) |
| Mortar resistance (test (viii)) | Paint film blistered | Paint film unchanged | Paint film blistered |

EXAMPLE 2

A plate of a commercially available pure aluminum metal (of a grade "JIS H4000, 1200") was moderately etched in immersing in a bath of an aqueous solution of 10% sodium hydroxide at 60°C for 2 minutes. The etched aluminum plate was then washed with water, neutralized by immersing in a bath of an aqueous solution of 15% nitric acid at ambient temperature for 30 minutes and then was washed with water. The aluminum plate so pretreated was subsequently anodized for 8 minutes in an electrolyte bath of an aqueous solution of 15% $H_2SO_4$ at 20°C using a direct electric current at a current density of 1 A/dm². The thickness of the oxide surface layer formed by this anodizing treatment was 2.0 microns. The anodized aluminum plate was cut down to make panels, from which the under-mentioned specimens Nos. 4 and 5 were prepared.

Specimen No. 4

The panel with the anodized oxide surface layer was well washed with water, dried in a clean air and then coated by dipping in a solution of 30% by weight of a commercially available vinylidene di-fluoride resin in methylisobutylphthalate. The coating film was stoved at 220°C for 30 minutes. The thickness of the heat-cured paint film was 47 microns.

Specimen No. 5

The panel with the anodized oxide surface layer was well washed with water, dried in a clean air and then applied with an aqueous solution of 0.2% by weight of N-(β-aminoethyl)-γ-aminopropyl tri-methoxysilane by immersing the panel in the latter solution for 1 minute. The panel so treated with the silane compound was then dried in a clear air and dehydrated by heating it an 150°C for 30 minutes.

The panel so pre-treated was then coated with the same vinylidene di-fluoride resin and by the same dipping procedure as those employed in the preparation of the specimen No. 4. The coating film was stoved at 220°C for 30 minutes. The thickness of the heat-cured paint film was 47.5 microns.

The specimen Nos. 4 and 5 were tested according to the Du pont impact test method with the dropping weight, the Erichsen film test method with the scribed paint film of the panels and a test method of stripping off the scribed paint film by means of adhesive tape adhered thereon, in order to estimate the adhestion properties of the paint film of these specimens. The specimen No. 4 suffered from the stripping off of the paint film in all the test methods, whereas the specimen No. 5 did not show the paint film stripping off in any of the test methods. It is recognized, therefore, that the adhesion properties of the paint film on the specimen No. 5 according to this invention was significantly improved as compared to those of the paint film of the specimen No. 4 which was a comparative sample.

EXAMPLE 3

The under-mentioned specimen Nos. 6 and 7 were prepared using the panels with the thin anodized oxide surface layer which were cut from the anodized aluminum strip made in Example 1.

Specimen No. 6

The panel was washed with water and dried, followed by coating with a commercially available paint based on a silicone-polyester resin by a known spraying method. The paint coating was stoved at 300°C for 60 minutes. The thickness of the stoved paint film was 22 microns.

Specimen No. 7

The panel was washed with water, dried and then pre-treated by immersing the panel for 5 seconds in a solution of 2% or γ-glycidoxypropyl trimethoxysilane in a solvent mixture of ethylalcohol and ethyl acetate. Immediately after the panel was removed from the silane solution, the panel was dried by blowing a hot air at 80°C thereonto to evaporate the solvent. After this, the panel was coated with the same silicone-polyester resin and by the same spraying procedure as those used in the preparation of the specimen No. 6. The coating film was stoved at 300°C for 60 minutes, and the thickness of the stoved paint film was 20.5 microns.

The paint films of the specimen Nos. 6 and 7 were compared with each other by different test methods in respect to the performance of the paint film. The difference in the performance of the paint films of these two specimens was found remarkedly by the boiling water treatment in which the specimens were immersed for 2 hours in a boiling bath of de-ionized water. Thus, the specimen No. 6 which had undergone the above-mentioned boiling water treatment showed a decreased adhesion of the paint film in the Du pont impact test, whereas the specimen No. 7 according to this invention did not show such a decreased adhesion of the paint film.

Moreover, the outer face of the paint film of the specimens which had undergone the boiling water treatment was further kept in contact with a mass of an aqueous solution of 2% of sodium hydroxide for 24 hours, in such a way that a short length of a polyvinyl chloride pipe of 1 inch diameter was placed to vertically stand on the surface of the paint film and the interface between the surface of the paint film and the end face of the pipe facing to the paint film was made liquid-tight by sealing with a paraffin wax and that the cavity of the vertically standing pipe was filled with the solution of 2% of sodium hydroxide while the assembly was placed in a thermostatic vessel at 20°C. In this test, fine blistering occurred in the whole surface area of the paint film of the specimen No. 6, whereas only a slight reduction in the gloss of the paint film surface was observed with the paint film of the specimen No. 7.

EXAMPLE 4

A test plate of a commercially available pure aluminum metal (of a grade "JIS H4000, 1200") was immersed for 30 minutes in an alkaline boiling water bath which was prepared by adding aqueous ammonia to pure water to adjust to a pH 10.8, so that the boehmite type oxide layer was formed at the surface of the aluminum plate. The aluminum plate with the boehmite surface layer was cut to make panels, from which the under-mentioned specimen Nos. 8 and 9 were prepared.

Specimen No. 8

The panel with the boehmite surface layer was coated with a paint based on a water-soluble thermosetting acrylic resin (which was prepared by neutralizing with tri-ethylamine, an acrylic copolymer formed by the interaction of 60 parts by weight of butyl acrylate, 20 parts by weight of methyl methacrylate, 10 parts by weight of N-methylol acrylamide and 10 parts of acrylic acid, mixing the resultant water-soluble acrylic copolymer with hexamethoxymethylol melamine in a proportion of 100 parts by weight of the acrylic copolymer to 25 parts by weight of the hexamethoxymethylol melamine, and then diluting the mixture with de-ionized water to a solid content of 20% by weight) by a known dipping technique. The coating film was stoved at 180°C for 30 minutes to heat-cure the resin. The thickness of the cured paint film was 18 microns.

Specimen No. 9

The panel with the boehmite surface layer was immersed in an aqueous solution of 0.5% of N-(β-aminoethyl-γ-aminopropyl methyldimethoxysilane for 1 minute and then dried by blowing a clear hot air at 80°C thereonto. After this, the dry panel pre-treated with the silane compound was coated with the same water-soluble thermo-setting acrylic resin paint and by the same dipping method as those employed in the preparation of the specimen No. 8. The coating film was stoved at 180°C for 30 minutes. The stoved paint film was 17 microns in thickness.

The specimen Nos. 8 and 9 were placed out-door in industrialized area of Nagoya City, Japan in such a way that each specimen panel was inclined at an angle of 45° to the horizontal plan with its paint film faced to the south. In these conditions, the specimens were left to be exposed to the weathering for 6 months. At the end of this period, the specimen No. 8 showed a remarked reduction in the gloss of the paint film surface, as compared to the specimen No. 9. After this exposure to the weathering, the specimens were further tested for the adhesion of the paint film, in such a way that intersecting scribelines were cut through the paint film to the face of the aluminum substrate and then the paint film was subjected to a stripping action by means of an adhesive Scotch tape. In this test, it was found that the specimen No. 8 showed a part of the paint film being stripped off, while the specimen No. 9 exhibited a good adhesion of the paint film.

What we claim is:

1. A process for coating an aluminum article, which comprises treating an aluminum article having an anodized oxide surface layer or a boehmite surface layer with a silane compound of the formula:

$$[R(CH_2)_n]-Si-X_3$$

wherein $n$ is 1, 2 or 3, R is an alkylenediamino group of 1–4 carbon atoms, an alkoxy group having an epoxy group and containing 1–4 carbon atoms, X is at least one group which is reactive with aluminol and is selected from the group consisting of an alkoxy group of 1–4 carbon atoms and an alkyl group of 1–4 carbon atoms provided that all of the group X do not constitute the alkyl group simultaneously; then coating the so-treated aluminum article with a known coating composition containing a thermo-setting resin as the film forming material by applying said coating composition onto the oxide layer surface of the aluminum article by means of a coating technique other than electrodeposition, and finally heat-curing the resin coating on the aluminum article.

2. A process as claimed in claim 1 in which the silane compound employed is N-(β-aminoethyl)-γ-aminopropyl trimethoxysilane.

3. A process as claimed in claim 1 in which the silane compound employed is N-(β-aminoethyl)-γ-aminopropyl methyldimethoxysilane.

4. A process as claimed in claim 1 in which the silane compound employed is γ-glycidoxypropyl tri-methoxysilane.

* * * * *